United States Patent [19]

Katagiri et al.

[11] 4,359,513

[45] Nov. 16, 1982

[54] ELECTROPHOTOGRAPHIC LIGHT-SENSITIVE DISAZO COMPOUNDS HAVING DIPHENYLACRYLONITRILE GROUP

[75] Inventors: Kazuharu Katagiri; Katsunori Watanabe; Shigeto Ohta; Shozo Ishikawa; Makoto Kitahara, all of Tokyo, Japan

[73] Assignees: Copyer Co., Ltd.; Canon Inc., both of Tokyo, Japan

[21] Appl. No.: 235,798

[22] Filed: Feb. 19, 1981

[30] Foreign Application Priority Data

Feb. 19, 1980 [JP] Japan ..... 55-18575

[51] Int. Cl.[3] ..... G03G 5/06

[52] U.S. Cl. ..... 430/58; 430/72; 430/76; 430/78; 430/79; 260/152; 260/155; 260/164; 260/184; 260/187

[58] Field of Search ..... 430/58, 72, 76, 78, 430/79; 260/152, 155, 164, 184, 187

[56] References Cited

U.S. PATENT DOCUMENTS

| | | | |
|---|---|---|---|
| 3,717,625 | 2/1973 | Peter et al. | 260/152 X |
| 3,829,410 | 8/1974 | Fisher et al. | 260/155 X |
| 4,260,672 | 4/1981 | Sasaki et al. | 430/58 X |
| 4,299,896 | 11/1981 | Hashimoto et al. | 430/58 |

*Primary Examiner*—Roland E. Martin, Jr.

*Attorney, Agent, or Firm*—Sughrue, Mion, Zinn, Macpeak & Seas

[57] ABSTRACT

An electrophotographic light-sensitive medium is described comprising a light-sensitive layer containing a dis-azo compound represented by Formula (1)

(1)

wherein A represents a coupler having aromatic properties.

12 Claims, No Drawings

ELECTROPHOTOGRAPHIC LIGHT-SENSITIVE DISAZO COMPOUNDS HAVING DIPHENYLACRYLONITRILE GROUP

BACKGROUND OF THE INVENTION

This invention relates to an electrophotographic light-sensitive medium prepared using a novel dis-azo compound containing therein an $\alpha,\beta$-diphenyl acrylonitrile group.

Various types of light-sensitive media bearing an electrically conductive layer and an organic pigment-containing layer provided on the electrically conductive layer have heretofore been known, including:

(1) a light-sensitive medium as disclosed in Japanese patent publication No. 1667/1977 in which a layer prepared by dispersing a pigment in an insulative binder is provided on an electrically conductive layer;

(2) a light-sensitive medium as disclosed in Japanese patent application (OPI) Nos. 30328/1972 (corresponding to U.S. Pat. Nos. 3,894,868) and 18545/1972 (corresponding to U.S. Pat. No. 3,870,516) in which a layer prepared by dispersing a pigment in a charge transport substance or a charge transport medium comprising the charge transport substance and an insulative binder (which may also be a charge transport substance) is provided on an electrically conductive layer;

(3) a light-sensitive medium as disclosed in Japanese patent application (OPI) No. 105537/1974 (corresponding to U.S. Pat. No. 3,837,851) which comprises an electrically conductive layer, a charge generation layer containing a pigment, and a charge transport layer; and (4) a light-sensitive medium as disclosed in Japanese patent application (OPI) No. 91648/1974 in which an organic pigment is added to a charge transfer complex.

As pigments for use in these light-sensitive media, a number of pigments, such as phthalocyanine based pigment, polycyclic quinone based pigment, azo based pigment and quinacridone based pigment, have been proposed, but few of them have been put in practice.

The reason for this is that these organic photoconductive pigments are inferior in sensitivity, durability, etc., to inorganic pigments such as Se, CdS, ZnO, etc.

However, light-sensitive media prepared using inorganic photoconductive pigments also suffer from disadvantages.

For example, with a light-sensitive medium prepared using Se, crystallization of Se is accelerated by heat, moisture, dust, finger print, etc., and in particular, when the atmospheric temperature of the light-sensitive medium exceeds about 40° C., the crystallization becomes significant, resulting in a reduction in charging properties and formation of white spots in an image. Although Se-based light-sensitive medium can theoretically produce about 30,000 to 50,000 copies, it often fails to produce so many copies because it is adversely influenced by the environmental conditions of the location where the copying machine in which it is used is placed.

In the case of a CdS-based light-sensitive medium covered with an insulative layer, its durability is nearly equal to that of the Se-based light-sensitive medium. Additionally, use of CdS results in deterioration of the moisture resistance of the CdS-based light-sensitive medium and it is very difficult to improve this poor moisture resistance. At the present time, therefore, it is necessary to provide an auxiliary means, e.g., a heater.

With a ZnO-based light-sensitive medium, the sensitization thereof is caused by the use of dyes exemplified by Rose Bengale and, therefore, problems such as deterioration due to corona charging and discoloration of dye by light arise. At the present time, it is generally believed that only about 1,000 copies can be produced by the Se-based light-sensitive medium.

Furthermore, the Se-based light-sensitive medium is expensive, and causes pollution problems, as is also the case with the CdS-based light-sensitive medium.

The sensitivity of conventional light-sensitive media, when expressed as an exposure amount for half decay (E $\frac{1}{2}$), is as follows: a Se-based light-sensitive medium which is not sensitized, about 15 lux.sec; a Se-based light-sensitive medium which is sensitized, about 4 to 8 lux.sec; a CdS-based light-sensitive medium, about equal to that of the sensitized Se-based light-sensitive medium; and a ZnO-based light-sensitive medium, about 7 to 12 lux.sec.

When the light-sensitive medium is used in a PPC (plane paper copior) copying machine (manufactured by Copyer Co., Ltd.), its sensitivity is desirably 20 lux.sec or less as E $\frac{1}{2}$, whereas when used in a PPC copying machine whose rate of duplication is higher, its sensitivity is more preferably 15 lux.sec or less as E $\frac{1}{2}$. Of course, light-sensitive media having lower sensitivities than above described can also be used depending on the purpose for which they are used, i.e., cases where the light-sensitive medium is not necessary to be repeatedly used, such as, for example, cases where the light-sensitive medium is used as a coating paper and a toner image is directly formed on the coating paper in copying of a drawing, etc.

SUMMARY OF THE INVENTION

As a result of extensive investigation to overcome the above described defects of the conventional inorganic light-sensitive media, and to overcome the above described defects of the organic electrophotographic light-sensitive media heretofore proposed, it has now been found that a light-sensitive medium prepared using a dis-azo compound containing therein an $\alpha,\beta$-diphenyl acrylonitrile group has high sensitivity and durability to such an extent that it can satisfactorily be put into practical use, and that it overcomes disadvantages of the inorganic light-sensitive media, e.g., poor heat resistance (crystallization of Se), poor moisture resistance, discoloration by light, pollution, etc.

This invention, therefore, provides an electro-photographic light-sensitive medium comprising a light-sensitive layer containing a dis-azo compound represented by Formula (1)

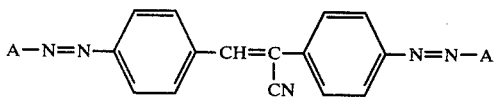

(1)

wherein A represents a coupler having aromatic properties.

DETAILED DESCRIPTION OF THE INVENTION

The dis-azo compound containing therein an $\alpha,\beta$-diphenyl acrylonitrile group which is used in this invention is represented by Formula (1)

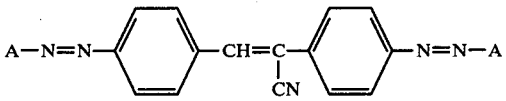

(1)

wherein A is a coupler having aromatic properties.

The term "a coupler having aromatic properties" referred to herein means an aromatic coupler containing therein a phenolic hydroxy group, such as, for example, a hydroxynaphthoic acid amide type coupler, a hydroxynaphthalic acid imide type coupler and an aminonaphthol type coupler.

Preferably, A is selected from those couplers represented by Formulae (2) to (4)

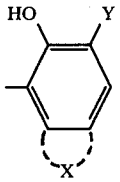

(2)

wherein X represents a group capable of being condensed with the benzene ring of Formula (2) to form a naphthalene ring, an anthracene ring, a carbazole ring or a dibenzofuran ring, and Y represents $—CONR_1R_2$ or $—COOR_2$, wherein $R_1$ represents a group selected from hydrogen, a substituted or unsubstituted alkyl group, and a substituted or unsubstituted phenyl group, and $R_2$ represents a group selected from a substituted or unsubstituted alkyl group, a substituted or unsubstituted phenyl group, a substituted or unsubstituted naphthyl group, a substituted or unsubstituted pyridyl group, and a substituted or unsubstituted hydrazino group.

Examples of the substituents for $R_1$ and $R_2$ include an alkyl group, e.g., methyl, ethyl, etc., a halogen atom, e.g., fluorine, chlorine, bromine, etc., an alkoxy group, e.g., methoxy, ethoxy, etc., an acyl group, e.g., acetyl, benzoyl, etc., an alkylthio group, e.g., methylthio, ethylthio, etc., an arylthio group, e.g., phenylthio, etc., an aryl group, e.g., phenyl, etc., an aralkyl group, e.g., benzyl, etc., a nitro group, a cyano group, a dialkylamino group, e.g., dimethylamino, diethylamino, etc., an alkylamino group, e.g., methylamino, ethylamino, etc., and so forth.

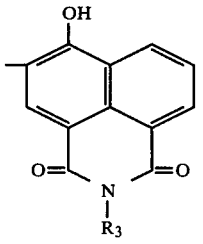

(3)

wherein $R_3$ is a substituted or unsubstituted alkyl group or a substituted or unsubstituted phenyl group.

In more detail, $R_3$ represents an alkyl group, e.g., methyl, ethyl, etc., a hydroxyalkyl group, e.g., hydroxymethyl, hydroxyethyl, etc., an alkoxyalkyl group, e.g., methoxymethyl, ethoxymethyl, ethoxyethyl, etc., a cyanoalkyl group, an aminoalkyl group, an N-alkylminoalkyl group, an aralkyl group, e.g., benzyl, phenethyl, etc., a phenyl group, a substituted phenyl group (examples of such substituents include those described in $R_1$ and $R_2$ of Formula (2)) or the like.

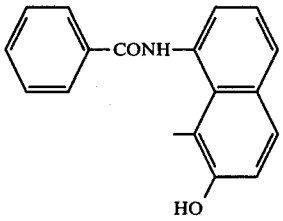

(4)

The dis-azo compound represented by Formula (1) can easily be prepared: (a) by tetraazotizing a starting material, e.g., a diamine of $\alpha,\beta$-bis(p-aminophenyl)acrylonitrile by the usual procedure (e.g., the method as described in K. H. Saunders, *The Aromatic Diazo Compounds And Their Technical Applications* (1949)) to form the corresponding tetrazonium salt and coupling the tetrazonium salt with a coupler represented by Formula (2), (3), or (4) in the presence of an alkali, or (b) by once isolating the above tetrazonium salt of diamine in a boron fluoride or zinc chloride form and then coupling the tetrazonium salt with a coupler represented by Formula (2), (3), or (4) in a suitable solvent, e.g., N,N-dimethylformamide, dimethyl sulfoxide, etc., in the presence of an alkali.

The above diamine can, as is known in the art, be obtained by condensing p-nitrobenzylcyanide and p-nitrobenzaldehyde in an alcohol solvent in the presence of sodium alkolate and then reducing the two nitro groups by the usual procedure (e.g., the method as described in *J. Chem. Soc.*, pp 1722–26 (1950)).

The electrophotographic light-sensitive medium of this invention is characterized by comprising a light-sensitive layer containing the dis-azo compound represented by Formula (1). The dis-azo compound represented by Formula (1) of this invention can be used in any of the light-sensitive media (1) to (4) as hereinbefore described, as well as in other known types. In order to increase the transport efficiency of charge carriers produced by light-absorption of the compound, it is desirable to use the dis-azo compound in the constructions of the light-sensitive media (2), (3) and (4). The optimum structure of the light-sensitive medium in which the dis-azo compound of this invention is to be used in that of the light-sensitive medium (3) in which the function of generating charge carriers and the function of transporting the charge carriers are separated, so that the characteristics of the dis-azo compound are efficiently exhibited.

The following explanation, therefore, is provided with respect to the electrophotographic light-sensitive medium of the optimum structure.

An electrically conductive layer, a charge generation layer and a charge transport layer are essential in the light-sensitive medium. The charge generation layer may be provided either on the charge transport layer or under the charge transport layer. In an electrophotographic light-sensitive medium of the type that is intended for repeated used, it is preferred that they are laminated in the order of the electrically conductive layer, the charge generation layer, and the charge transport layer, mainly from a viewpoint of physical strength and in some cases from a viewpoint of charging properties. For the purpose of increasing the adhesion between the electrically conductive layer and the charge generation layer, if desired, an adhesion layer may be provided therebetween.

As the electrically conductive layer, those having a surface resistance of about $10^{10}\Omega$ or less, preferably, about $10^{7}\Omega$ or less, such as a metal (e.g., aluminum) plate or foil, a metal (e.g., aluminum) vapor deposited plastic film, a sheet prepared by bonding together an aluminum foil and paper, a paper rendered electrically conductive, etc., can be used.

Materials which can be effectively used in forming the adhesion layer include casein, polyvinyl alcohol, water-soluble polyethylene, nitrocellulose and the like.

The thickness of the adhesion layer is from about $0.1\mu$ to $5\mu$ and preferably from about $0.5\mu$ to $3\mu$.

Fine particles of the dis-azo compound of Formula (1) are coated, if necessary after being dispersed in a suitable binder, on a charge generation layer or an adhesion layer provided on the electrically conductive layer. The dispersion of the dis-azo compound can be carried out by known procedures using a ball mill, an attritor, or the like. The particle size of the dis-azo compound is usually about $5\mu$ or less and preferably about $2\mu$ or less, with the optimum particle size being about $0.5\mu$ or less.

The dis-azo compound can be dissolved in an amine-based solvent, e.g., ethylenediamine, and coated. The coating of the dis-azo compound can be carried out by known methods, such as blade coating, Meyer bar coating, spray coating, soak coating, etc.

The thickness of the charge generation layer is usually about $5\mu$ or less and preferably from about $0.01\mu$ to $1\mu$.

Where a binder is used in the charge generation layer, the proportion of the binder in the charge generation layer is usually about 80% or less and preferably about 40% or less, because if the amount of the binder is large, the sensitivity of the light-sensitive medium will be adversely affected.

Binders which can be used include polyvinyl butyral, polyvinyl acetate, polyester, polycarbonate, a pheoxy resin, an acryl resin, polyacrylamide, polyamide, polyvinyl pyridine, a cellulose resin, an urethane resin, an epoxy resin, casein, polyvinyl alcohol, etc.

In order to achieve uniform injection of charge carriers from the charge generation layer into the charge transport layer lying on the charge generation layer, if necessary, the surface of the charge generation layer can be ground and planished.

On the thus-provided charge generation layer is provided the charge transport layer. Where the charge transport substance has no film-forming capability, a binder is dissolved in a suitable solvent and coated by the conventional procedure to form the charge transport layer. The charge transport substance is divided into an electron transport substance and a positive hole transport substance.

Examples of such electron transport substances include electron attractive substances such as chloranil, bromanil, tetracyanoethylene, tetracyanoquinodimethane, 2,4,7-trinitro-9-fluorenone, 2,4,5,7-tetranitrofluorenone, 2,4,7-trinitro-9-dicyanomethylenefluorenone, 2,4,5,7-tetranitroxanthone, 2,4,8-trinitrothioxanthone, etc., and their polymerization products.

Examples of positive hole transport substances include pyrene, N-ethyl carbazole, N-isopropyl carbazole, 2,5-bis(p-diethylaminophenyl)-1,3,4-oxadiazole, 1-phenyl-3-(p-diethylaminostyryl)-5-(p-diethylaminophenyl)pyrazoline, 1-(pyridyl-(2))-3-(p-diethylaminostyryl)-5-(p-diethylaminophenyl)pyrazoline, 1-(quinolyl-(2))-3-(p-diethylaminostyryl)-5-(p-diethylamonophenyl)pyrazoline, triphenylamine, poly-N-vinyl carbazole, halogenated poly-N-vinyl carbazole, polyvinyl pyrene, polyvinyl anthracene, polyvinyl acridine, poly-9-vinylphenyl anthracene, a pyrene-formaldehyde resin, an ethyl carbazole-formaldehyde resin, etc.

Charge transport substances which can be used are not limited to the above described ones, and they can be used alone or in combination with each other. The thickness of the charge transport layer is usually from about $5\mu$ to $30\mu$ and preferably from about $8\mu$ to $20\mu$.

Binders which can be used include an acryl resin, polystyrene, polyester, polycarbonate, etc. As binders for low molecular weight positive hole transport substances, positive hole transport polymers such as poly-N-vinyl carbazole can be used. On the other hand, as binders for low molecular weight electron transport substances, polymers of electron transport monomers as described in U.S. Pat. No. 4,122,113 can be used.

In the light-sensitive medium comprising the electrically conductive layer, the charge generation layer on the electrically conductive layer, and the charge transport layer on the charge generation layer wherein the charge transport substance is an electron transport substance, the surface of the charge transport layer is required to be charged positively, and when the light-sensitive medium is exposed to light after the charging, electrons generated in the charge generation layer are injected into the charge transport layer at exposed areas and reach the surface of the charge transport layer, neutralizing positive charges thereon, as a result of which a decay of surface potential occurs, and electrostatic contrast is formed between exposed areas and unexposed areas. On developing the thus-formed electrostatic latent image with negatively charged toners, a visible image is obtained. This visible image can be fixed either directly or after being transferred to paper or a plastic film.

Alternatively, the electrostatic latent image may be transferred onto an insulative layer of a transfer paper, and then developed and fixed. The type of the developer, the developing method and the fixing method are not critical, and any known developer, developing method and fixing method can be employed.

On the other hand, when the charge transport substance is composed of a positive hole transport substance, the surface of the charge transport layer is required to be charged negatively, and when the light-sensitive medium is exposed to light after the charging, positive holes generated in the charge generation layer are injected into the charge transport layer at exposed areas and then reach the surface of the charge transport layer, neutralizing the negative charges, as a result of which the decay of surface potential occurs and the electrostatic contrast is formed between exposed areas and unexposed areas. In this case, therefore, it is necessary to use positively charged toners for development of electrostatic latent images.

A light-sensitive medium of type (1) according to the present invention can be prepared by dispersing the dis-azo compound of Formula (1) in an insulative binder solution as used in the charge transport layer of the light-sensitive medium of type (3) as described above and coating the resulting dispersion on an electrically conductive support.

A light-sensitive medium of type (2) according to the present invention can be prepared by dissolving an insulative binder as used in the charge transport substance and charge transport layer of the light-sensitive medium of type (3) in a suitable solvent, dispersing the dis-azo compound of Formula (1) in the solution obtained above, and by coating the resulting dispersion on an electrically conductive support.

A light-sensitive medium of type (4) according to the present invention can be prepared by dispersing the dis-azo compound of Formula (1) in a solution of a charge transfer complex, which is formed on mixing the electron transport substance described in the light-sensitive medium of type (3) and the positive hole transport substance, and coating the resulting dispersion on the electrically conductive support.

If desired, the dis-azo compound of Formula (1) may be used in combination with other compounds as pigments having different light absorption ranges in order to increase the sensitivity of the light-sensitive medium. Furthermore, for the purpose of obtaining panchromatic light-sensitive media, two or more of the dis-azo compounds may be combined together, or the dis-azo compound may be used in combination with charge generating substances selected from known dyes and pigments.

The electrophotographic light-sensitive medium of this invention can be used not only in an electrophotographic copying machine, but also in other applications wherein electrophotography is utilized, such as laser printing, CRT (cathode-ray tube) printing, etc.

Hereinafter, the dis-azo compounds as used in this invention will be explained by reference to the preparation of examples thereof.

Synthesis Example

Preparation of Compound No. 1

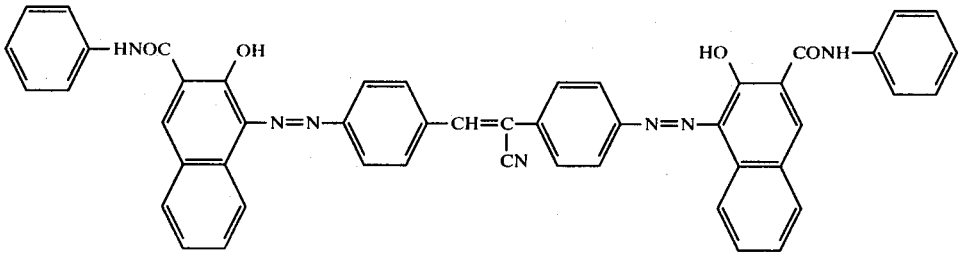

A mixture of 32 ml of water, 12.4 ml (0.14 mol) of concentrated hydrochloric acid and 5.0 g (0.021 mol) of α,β-bis(p-aminophenyl)acrylonitrile was placed in a 100-ml beaker and adjusted to 3° C. by cooling in an ice water bath while stirring. A solution of 3.1 g (0.045 mol) of sodium nitrite in 7 ml of water was then dropwise added to the above mixture over a period of 10 minutes while maintaining the temperature of the resulting mixture at 3° to 6° C. At the end of the time, the reaction mixture was stirred at that temperature for an additional 30 minutes. Carbon was then added to the reaction mixture, and the resulting mixture was filtered to obtain a tetrazonium salt solution.

Next, 17.9 g (0.45 mol) of caustic soda was dissolved in 600 ml of water placed in a 2-liter beaker, and 11.8 g (0.045 mol) of Naphthol AS (3-hydroxy-2-naphthoic acid anilide) was dissolved therein to form a coupler solution.

To the thus-obtained coupler solution was dropwise added the tetrazonium salt solution obtained above over a period of 30 minutes while maintaining the temperature of the resulting mixture at 5° to 7° C. by cooling in an ice water bath. At the end of the time, the ice water bath was removed, and the reaction mixture was stirred at room temperature for 2 hours and then allowed to stand overnight.

The reaction mixture was filtered to obtain a solid portion. The solid portion was washed with water, acetone and then with MEK (methyl ethyl ketone) and dried to obtain 12.5 g of a crude pigment. The crude pigment was heat-filtered five times with 400 ml portions of DMF (dimethylformamide) and dried by heating under reduced pressure to obtain 8.3 g of a purified compound.

Yield: 50%

Decomposition Point: more than 300° C.

Visible Absorption Spectrum:

Maximum absorption wavelength 577 nm (o-dichlorobenzene solution)

IR Absorption Spectrum:

Amide 1670 $cm^{-1}$, nitrile 2200 $cm^{-1}$

Using couplers other than Naphthol AS represented by Formula (2), additional compounds according to this invention can be synthesized in the same manner as described above.

The following Examples of electrophotographic media are provided to illustrate this invention in greater detail.

EXAMPLE 1

An ammonium aqueous solution of casein (casein 11.2 g, 28% aqueous ammonia 1 g, and water 222 ml) was coated on an aluminum vapor-deposited Mylar (trademark of E. I. du Pont for polyethylene terephthalate) film at the side of the aluminum surface with a Meyer bar to form an adhesion layer of a coating amount of 0.8 $g/m^2$.

Next, 5 g of Compound No. 1 and a solution of 2 g of a butyral resin (degree of butyralation, 63 mol %) in 95 ml of ethanol were ball-milled for 40 hours to prepare a dispersion. This dispersion was coated on the adhesion layer obtained above to form a charge generation layer of a coating amount of 0.18 $g/m^2$.

Next, a solution of 5 g of 1-phenyl-3-(p-diethylaminostyryl)-5-(p-diethylaminophenyl)pyrazoline and 5 g of poly-4,4'-dioxydiphenyl-2,2-propanecarbonate (molecular weight, 30,000) in 70 ml of tetrahydrofuran was coated on the charge generation layer obtained above with a Baker applicator and dried to form a charge transport layer of a coating amount of 10 g/m$^2$.

The thus-obtained electrophotographic light-sensitive medium was conditioned at 20° C. and 65% relative humidity for 24 hours, corona-discharged at −5 kv by the use of an electrostatic copying paper testing apparatus, Model SP-428 (produced by Kawaguchi Denki Co., Ltd.) according to the static method, and held in a dark place for 10 seconds. At the end of the time, it was exposed to light at an intensity of illumination of 5 lux, and its charging characteristics were examined.

The results are shown below, wherein $V_o$ (−v), $V_k$ (%) and E ½ (lux.sec) indicate, respectively, the initial potential, the potential retention in a dark place for the period of 10 seconds, and the exposure amount for half decay.

$V_o$—−560 v
$V_k$—87%
E ½—4.1 lux.sec

EXAMPLE 2

On the charge generation layer prepared in Example 1 was coated a solution of 5 g of 2,5-bis(p-diethylaminophenyl)-1,3,4-oxadiazole and 5 g of the same polycarbonate as used in Example 1 in 70 ml of tetrahydrofuran with a Baker applicator and dried to form a charge transport layer coated at 11 g/m$^2$.

The thus-obtained light-sensitive medium was measured in charging characteristics in the same manner as in Example 1. The results are shown below:

$V_o$—−535 v
$V_k$—95%
E ½—4.6 lux.sec

EXAMPLE 3

On the charge generation layer prepared in Example 1 was coated a solution of 5 g of triphenylamine, 5 g of poly-N-vinyl carbazole (molecular weight, 300,000) and 0.5 g of p-terphenyl in 70 ml of tetrahydrofuran with a Meyer bar and dried to form a charge transport layer of a coating amount of 10 g/m$^2$.

The thus-obtained light-sensitive medium was measured in charging characteristics in the same manner as in Example 1. The results are shown below:

$V_o$—−570 v
$V_k$—92%
E ½—15 lux.sec

EXAMPLE 4

A mixture of 5 g of Compound No. 2 having the following formula

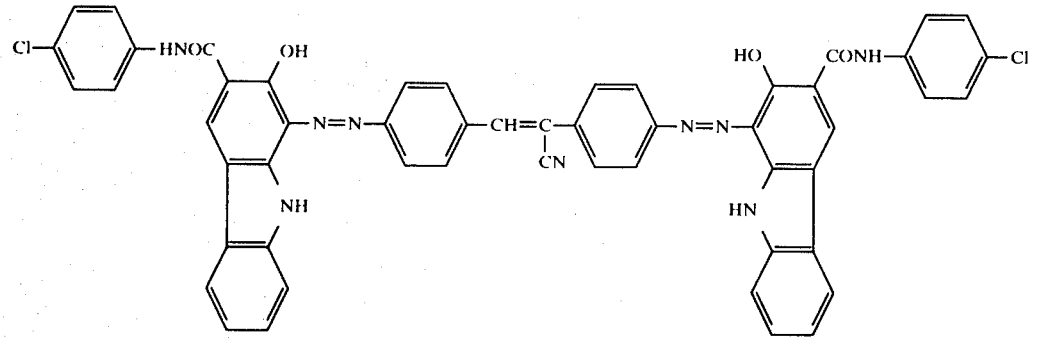

and a solution of 2 g of a butyral resin (degree of butyralation, 63 mol %) in 95 ml of ethanol was ball-milled for 40 hours, and the resulting dispersion was then coated on the adhesion layer prepared in Example 1 with a Meyer bar and dried to form a charge generation layer of a coating amount of 0.25 g/m$^2$.

On the charge generation layer so prepared was provided a charge transport layer in the same manner as described in Example 1.

The thus-obtained light-sensitive medium was measured in charging characteristics in the same manner as in Example 1. The results are as follows:

$V_o$—−560 v
$V_k$—89%
E ½—5.2 lux.sec

EXAMPLE 5

On the charge generation layer prepared in Example 1 was coated a solution of 5 g of 1-(quinolyl-(2))-3-(p-diethylaminostyryl)-5-(p-diethylaminophenyl)pyrazoline and 5 g of a polymethyl methacrylate resin (molecular weight, 100,000) in 70 ml of tetrahydrofuran with a Meyer bar and dried to form a charge transport layer of a coating amount of 10 g/m$^2$.

The thus-obtained light-sensitive medium was measured in charging characteristics in the same manner as in Example 1. The results are as follows:

$V_o$—−550 v
$V_k$—93%
E ½—5.3 lux.sec

Next, the same light-sensitive medium as obtained above was conditioned at 50° C. and 80% (relative humidity) for 24 hours. At the end of the time, the light-sensitive medium was measured in charging characteristics in the same manner as in Example 1. The results are as follows:

$V_o$—−540 v
$V_k$—92%
E ½—5.5 lux.sec

The charging characteristics of the light-sensitive medium was stabilized against temperature and moisture, and no changes in the coating films occurred. It was thus confirmed that a light-sensitive medium of this invention has excellent properties.

EXAMPLE 6

A mixture of 5 g of the same polycarbonate as used in Example 1 and 5 g of 1-(pyridyl-(2))-3-(p-diethylaminostyryl)-5-(p-diethylaminophenyl)pyrazoline was dissolved in 60 ml of tetrahydrofuran, and 1.0 g of Compound No. 2 was then added thereto. The resulting mixture was ball-milled for 40 hours to form a dispersion. This dispersion was coated on the same aluminum plate with the adhesion layer provided thereon as used in Example 1 at the side of the adhesion layer and dried to form a light-sensitive layer of a coating amount of 10 g/m$^2$.

The thus-obtained light-sensitive medium was measured in charging characteristics in the same manner as in Example 1. The results are as follows:

$V_o$—+510 v
$V_k$—88%
E $\frac{1}{2}$—19 lux.sec

EXAMPLES 7 TO 27

In these examples, a series of light-sensitive media were prepared using various compounds in which A (coupler) of Formula (1) was changed.

A mixture of 5 g of a dis-azo compound wherein A is shown in Table 1, 10 g of a polyester resin solution (Polyester Adhesive 49000, produced by E. I. du Pont Co., Ltd.; solid content, 20%) and 80 ml of tetrahydrofuran was ball-milled for 60 hours to form a dispersion. This dispersion was coated on an aluminum vapor-deposited Mylar film at the side of the aluminum surface with a Meyer bar and dried to form a charge generation layer of a coating amount of 0.28 g/m$^2$.

A solution of 5 g of 1-phenyl-3-(p-diethylaminostyryl)-5-(p-diethylaminophenyl)pyrazoline and 5 g of the same polycarbonate as used in Example 1 in 70 ml of tetrahydrofuran was coated on the charge generation layer prepared above with a Baker applicator and dried to form a charge transport layer of a coating amount of 10 g/m$^2$.

The thus-obtained light-sensitive medium was measured in charging characteristics in the same manner as described in Example 1.

The results are shown in Table 1.

TABLE 1

| Example | Compound No. | A (Coupler) of Formula (1) | $V_o$ (−v) | $V_k$ (%) | E$\frac{1}{2}$ (lux.sec) |
|---|---|---|---|---|---|
| 7 | 3 | 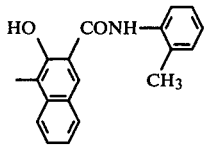 | 580 | 89 | 5.5 |
| 8 | 4 | 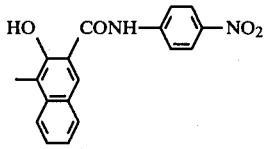 | 495 | 83 | 5.1 |
| 9 | 5 | 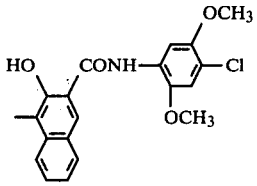 | 530 | 90 | 5.9 |
| 10 | 6 | 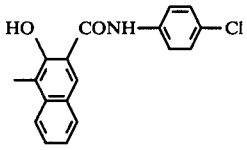 | 555 | 88 | 7.0 |
| 11 | 7 | 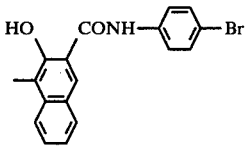 | 560 | 94 | 7.2 |
| 12 | 8 | 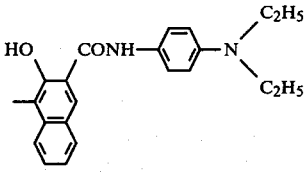 | 480 | 86 | 6.6 |

TABLE 1-continued
| Example | Compound No. | A (Coupler) of Formula (1) | $V_o$ (−v) | $V_k$ (%) | $E_{\frac{1}{2}}$ (lux.sec) |
|---|---|---|---|---|---|
| 13 | 9 | 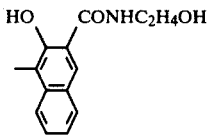 | 500 | 84 | 13 |
| 14 | 10 | 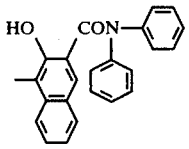 | 530 | 87 | 5.8 |
| 15 | 11 | 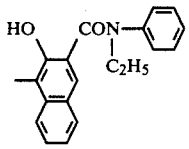 | 515 | 86 | 7.8 |
| 16 | 12 | 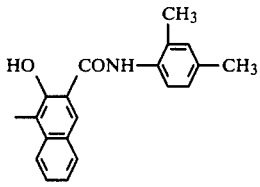 | 545 | 89 | 5.9 |
| 17 | 13 | 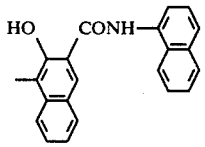 | 590 | 93 | 5.4 |
| 18 | 14 | 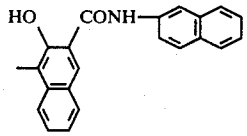 | 520 | 88 | 6.3 |
| 19 | 15 | 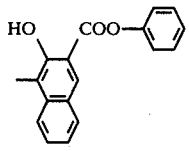 | 560 | 90 | 9.8 |
| 20 | 16 | 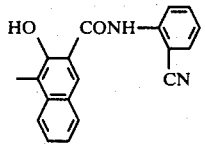 | 580 | 89 | 5.9 |
| 21 | 17 | 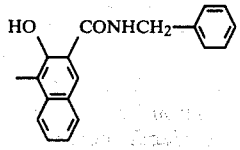 | 495 | 84 | 7.6 |

TABLE 1-continued

| Example | Compound No. | A (Coupler) of Formula (1) | $V_o$ (−v) | $V_k$ (%) | $E_{\frac{1}{2}}$ (lux.sec) |
|---|---|---|---|---|---|
| 22 | 18 | 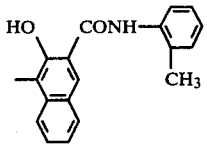 | 565 | 87 | 5.8 |
| 23 | 19 | 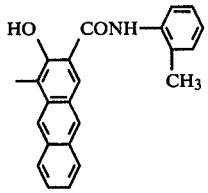 | 540 | 88 | 5.4 |
| 24 | 20 | 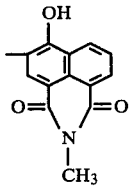 | 550 | 90 | 7.0 |
| 25 | 21 | 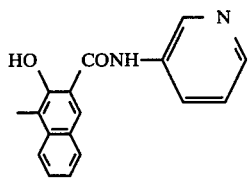 | 560 | 92 | 13.5 |
| 26 | 22 | 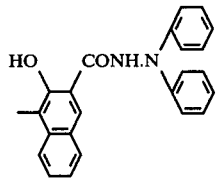 | 550 | 91 | 12.0 |
| 27 | 23 | 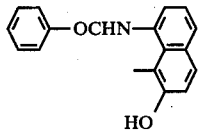 | 540 | 93 | 6.8 |

EXAMPLE 28

A mixture of 20 g of polyvinyl carbazole (Tuvicol 100, produced by Takasago Perfumery Co., Ltd.) and 4.0 g of 2,4,7-trinitrofluorenone was dissolved in tetrahydrofuran, and the resulting solution and 2.0 g of Compound No. 2 were ball-milled for 40 hours to form a dispersion. This dispersion was coated on the same aluminum vapor-deposited Mylar film with the adhesion layer provided thereon as used in Example 1 at the side of the adhesion layer with a Meyer bar to provide a coating amount of 11 g/m$^2$.

The thus-obtained light-sensitive medium was measured in charging characteristics in the same manner as in Example 1. The charging polarity was positive. The results are shown below:

$V_o$—+450 v $V_k$—83%

$E_{\frac{1}{2}}$—18 lux.sec

EXAMPLE 29

On an aluminum surface were coated the same adhesion layer, charge generation layer and charge generation layer as used in Example 5 by the dipping method to form a light-sensitive medium.

The thus-obtained drum was mounted on a PPC copying machine (testing apparatus) (produced by Copyer Co., Ltd.) in which a two component developer was used. The surface potential was set to −600 v, and 20,000 copies were produced. During the time, both variations in surface potential and in sensitivity were markedly small and beautiful copies were obtained. It was thus confirmed that the light-sensitive medium of this invention was excellent in durability.

While the invention has been described in detail and with reference to specific embodiments thereof, it will be apparent to one skilled in the art that various changes and modifications can be made therein without departing from the spirit and scope thereof.

What is claimed is:

1. An electrophotographic light-sensitive medium comprising a light-sensitive layer containing a dis-azo compound represented by Formula (1)

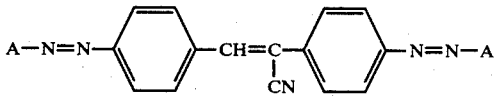

(1)

wherein A represents a coupler having aromatic properties.

2. An electrophotographic light-sensitive medium as in claim 1, wherein A of Formula (1) is represented by Formula (2)

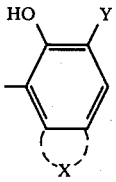

(2)

wherein

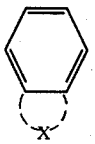

is selected from the group consisting of a naphthalene ring, an anthracene ring, a carbazole ring and a dibenzofuran ring, and Y is $—CONR_1R_2$ or $—COOR_2$, wherein $R_1$ is selected from the group consisting of hydrogen, a substituted or unsubstituted alkyl group, and a substituted or unsubstituted phenyl group, and $R_2$ is selected from the group consisting of a substituted or unsubstituted alkyl group, a substituted or unsubstituted phenyl group, a substituted or unsubstituted naphthyl group, a substituted or unsubstituted pyridyl group, and a diphenylamino group.

3. An electrophotographic light-sensitive medium as in claim 1, wherein A of Formula (1) is represented by Formula (3)

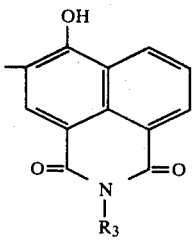

(3)

wherein $R_3$ is selected from the group consisting of a substituted or unsubstituted alkyl group and a substituted or unsubstituted phenyl group.

4. An electrophotographic light-sensitive medium as in claim 1, wherein A of Formula (1) is represented by Formula (4)

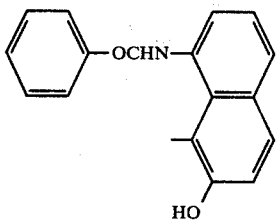

5. An electrophotographic light-sensitive medium as in claim 1, wherein the dis-azo compound of formula (1) has the structural formula

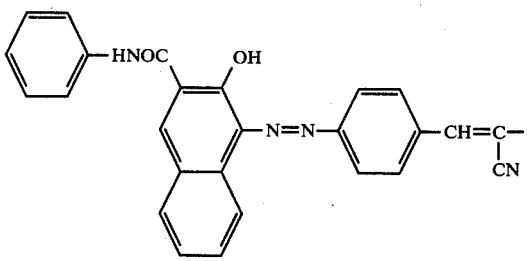

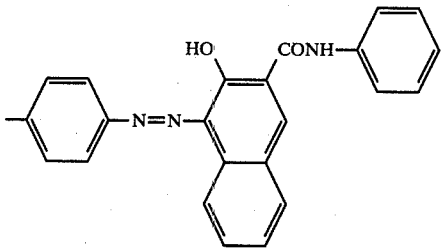

6. An electrophotographic light-sensitive medium as in claim 1, 2, 3, 4 or 5, wherein the light-sensitive medium comprises an electrically conductive layer, a light-sensitive charge generation layer containing the dis-azo compound represented by Formula (1), and a charge transport layer.

7. An electrophotographic light-sensitive medium as in claim 6, wherein the layers are laminated in the order of the electrically conductive layer, the charge generation layer, and the charge transport layer.

8. An electrophotographic light-sensitive medium as in claim 6, wherein the thickness of the charge generation layer is about 5μ or less.

9. An electrophotographic light-sensitive medium as in claim 6, wherein the thickness of the charge generation layer is from about 0.01μ to 1μ.

10. A dis-azo compound represented by Formula (1)

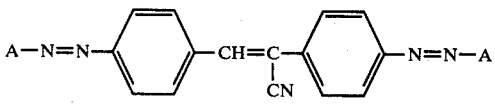

(1)

wherein A represents a copolymer having aromatic properties.

11. A dis-azo compound as in claim 10, wherein A of Formula (1) is represented by the Formula (2), Formula (3) or Formula (4):

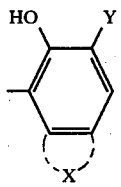

(2)

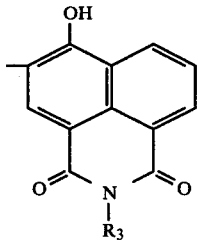

(3)

-continued

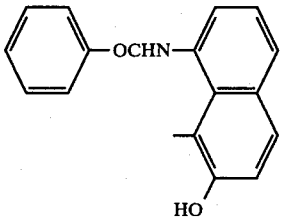

(4)

wherein

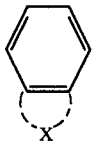

is selected from the group consisting of a naphthalene ring, an anthracene ring, a carbazole ring and a dibenzofuran ring, Y is $—CONR_1R_2$ or $—COOR_2$, wherein $R_1$ is selected from the group consisting of hydrogen, a substituted or unsubstituted alkyl group, and a substituted or unsubstituted phenyl group, and $R_2$ is selected from the group consisting of a substituted or unsubstituted alkyl group, a substituted or unsubstituted phenyl group, a substituted or unsubstituted naphthyl group, a substituted or unsubstituted pyridyl group, and a diphenylamino group, and $R_3$ is selected from the group consisting of a substituted or unsubstituted alkyl group and a substituted or unsubstituted phenyl group.

12. A dis-azo compound as in claim 11, wherein said dis-azo compound is represented by the Formula

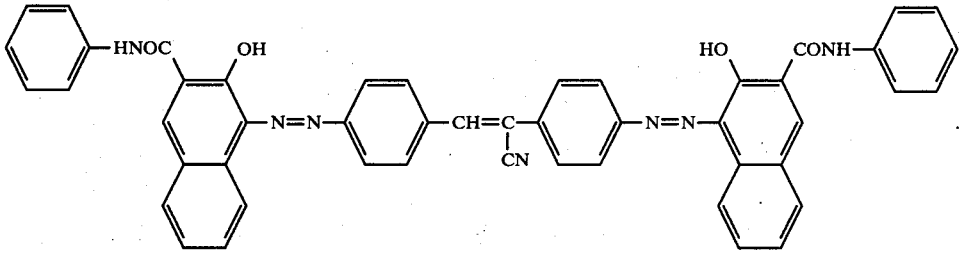

* * * * *